US011412785B2

(12) United States Patent
Washington

(10) Patent No.: US 11,412,785 B2
(45) Date of Patent: Aug. 16, 2022

(54) PACKER SUPPORT BRIEF

(71) Applicant: Marli Washington Design, LLC, Upper Marlboro, MD (US)

(72) Inventor: Marli J. Washington, Upper Marlboro, MD (US)

(73) Assignee: MARLI WASHINGTON DESIGN, LLC, Upper Marlboro, MD (US)

( * ) Notice: Subject to any disclaimer, the term of this patent is extended or adjusted under 35 U.S.C. 154(b) by 168 days.

(21) Appl. No.: 16/912,362

(22) Filed: Jun. 25, 2020

(65) Prior Publication Data

US 2021/0401065 A1 Dec. 30, 2021

(51) Int. Cl.

| | |
|---|---|
| ***A41B 9/02*** | (2006.01) |
| ***A41B 9/00*** | (2006.01) |
| *A41B 9/14* | (2006.01) |

(52) U.S. Cl.

CPC ..... *A41B 9/023* (2013.01); *A41B 9/004* (2013.01); *A41B 9/007* (2013.01); *A41B 9/02* (2013.01); *A41B 9/026* (2013.01); *A41B 9/14* (2013.01)

(58) Field of Classification Search

CPC ..... A41B 9/023; A41B 9/004; A41B 9/007; A41B 9/02; A41B 9/026; A41B 9/14

See application file for complete search history.

(56) References Cited

U.S. PATENT DOCUMENTS 3,207,155 A * 9/1965 Casey ..... A41B 9/026 602/67
4,622,962 A * 11/1986 Kauffman ..... A61F 5/40 602/70
5,283,912 A * 2/1994 Chung ..... A41B 9/023 2/403
6,038,703 A * 3/2000 Chung ..... A61F 5/40 2/403
2005/0268380 A1 12/2005 Sovell

FOREIGN PATENT DOCUMENTS

WO 2011089455 A1 7/2011

OTHER PUBLICATIONS

"Packing 101: packing underwear", May 17, 2016, www.youtube.com/watch?v=D3nV618rGoc&feature=youtu.be <http://www.youtube.com/watch?v=D3nV618rGoc&feature=youtu.be>.

Thomas Underwood, "A Guide to Packing Underwear for Transmen", Apr. 15, 2017 ftm-guide.com/guide-to-packing-underwear-for-transmen/ <https://ftm-guide.com/guide-to-packing-underwear-for-transmen/>.

Cow Hitch-End Method Apr. 8, 2011, www.animatedknots.com/cow-hitch-knot-end-method.

Int'l Search Report and Written Opinion dated Sep. 30, 2021 in Int'l Applcation No. PCT/US21/38292.

* cited by examiner

*Primary Examiner* — Khaled Annis

(74) *Attorney, Agent, or Firm* — Panitch Schwarze Belisario & Nadel LLP

(57) ABSTRACT

A packer-support brief for releasably retaining a packer in the packer-support brief has a male underwear in the form of a brief with a waistband at an upper portion of the brief. A pocket is below the waistband. The pocket is configured to removably receive the packer. An attachment loop is attached to the waistband and extends into the pocket. An endless loop has a first end attached to the attachment loop and a second end removably attachable to the packer.

10 Claims, 4 Drawing Sheets

PACKER SUPPORT BRIEF

BACKGROUND OF THE INVENTION

The present invention relates to a packer-support brief.

A packer is a phallic object worn in underwear or a brief to give the appearance of having a penis. Packers are most often used by transgender men, individuals who were assigned female at birth but have a male gender identity (hereafter referred to as "transmen"). Occasionally, packers are worn by cis men, men who are comfortable identifying with the assigned male gender at birth, to give the appearance of a more impressive bulge.

Packers can range from a rolled-up sock stuffed in a brief to an expensive medical prosthesis attachable to the body with surgical glue. The choice of a packer is always a personal choice. Some transmen may be more concerned with a soft, realistic feel while others may focus on what the packer looks like or how uncomfortable it will be to wear.

The position of a packer worn in a brief is important. The packer should not be too low or too high. Correctly positioned, the packer should anatomically resemble a penis. Keeping a packer in proper anatomical place is extremely important. If regular underwear is worn, the packer may shift to an undesired position or even fall out. Accordingly, there is a need in the underwear art for a custom designed brief able to provide secure positioning of a packer in a support brief.

BRIEF SUMMARY OF THE INVENTION

Briefly stated, one embodiment of the present invention is directed to a packer-support brief for releasably retaining a packer in the packer-support brief. The packer-support brief includes a male underwear in the form of a brief with a waistband at an upper portion of the brief. A pocket is below the waistband. The pocket is configured to removably receive the packer. An attachment loop is attached to the waistband and extends into the pocket. An endless loop has a first end attached to the attachment loop and a second end removably attachable to the packer.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, the drawings show an embodiment which are presently preferred. It should be understood, however, that the invention is not limited to the precise arrangement and instrumentalities shown.

In the drawings.

DETAILED DESCRIPTION OF THE INVENTION

Figure 1:
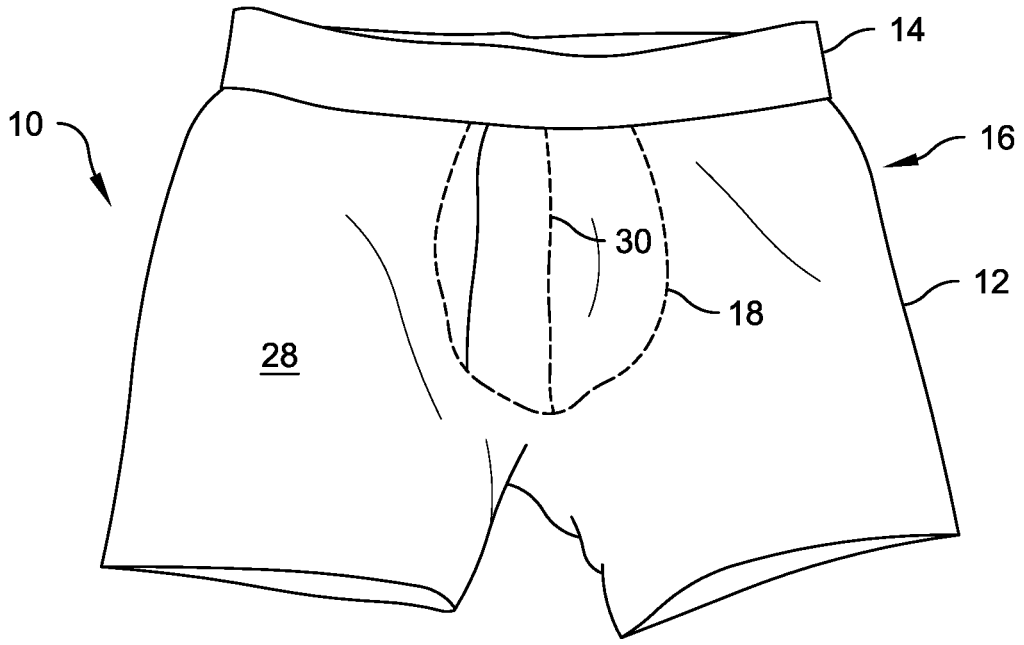
FIG. 1 is an outwardly facing front elevation view of a preferred embodiment of a packer-support brief in accordance with the present invention.

Reference will now be made in detail to embodiments of the invention, examples of which are illustrated in the accompanying drawings. The terminology used in the description of the invention herein is for the purpose of describing particular embodiments only and is not intended to be limiting of the invention.

As used in the description of the invention and the appended claims, the singular forms "a", "an" and "the" are intended to include the plural forms as well, unless the context clearly indicates otherwise. The words "and/or" as used herein refers to and encompasses any and all possible combinations of one or more of the associated listed items. The words "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The words "right," "left," "lower" and "upper" designate directions in the drawings to which reference is made. The words "inwardly" and "outwardly" refer to directions toward and away from, respectively, the geometric center of the cutter deck leveling fine adjustment, and designated parts thereof. The terminology includes the words noted above, derivatives thereof and words of similar import.

Although the words first, second, etc., are used herein to describe various elements, these elements should not be limited by these words. These words are only used to distinguish one element from another. For example, a first cow hitch could be termed second cow hitch, and, similarly, a second cow hitch could be termed a first cow hitch, without departing from the scope of the present invention.

The following description is directed towards various embodiments of a needle safety shield in accordance with the present invention.

Figure 2:
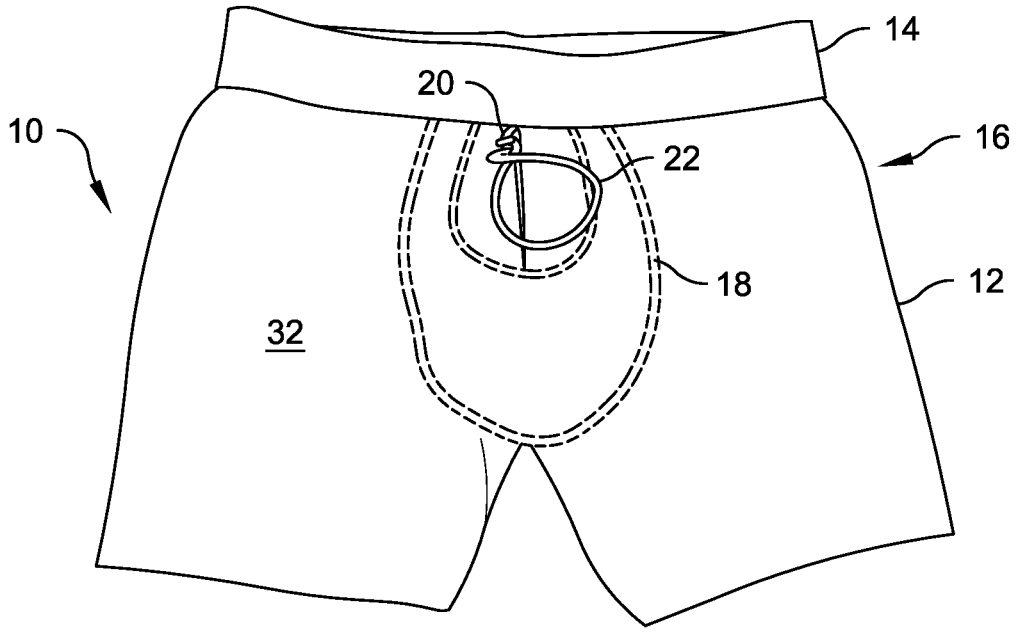
FIG. 2 is an inwardly facing front elevation view of the packer-support brief of FIG. 1.
Figure 3:
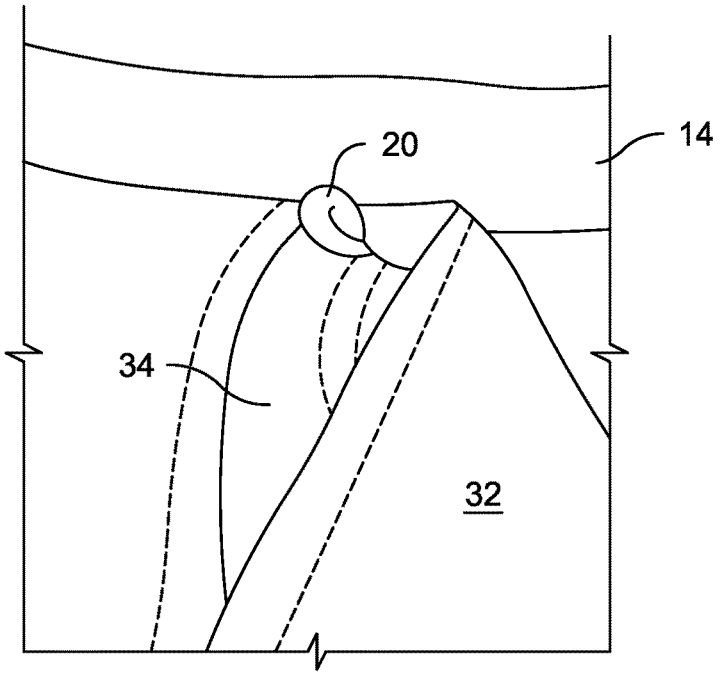
FIG. 3 is an enlarged inwardly facing front elevation view of a portion of the packer-support brief of FIG. 2 showing an attachment loop in the pocket of the packer-support brief.
Figure 4:
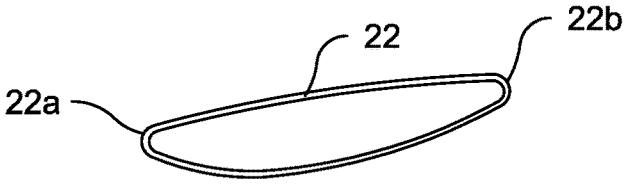
FIG. 4 is a top front perspective view of a round endless loop insertable in the attachment loop of FIG. 3.
Figure 5:
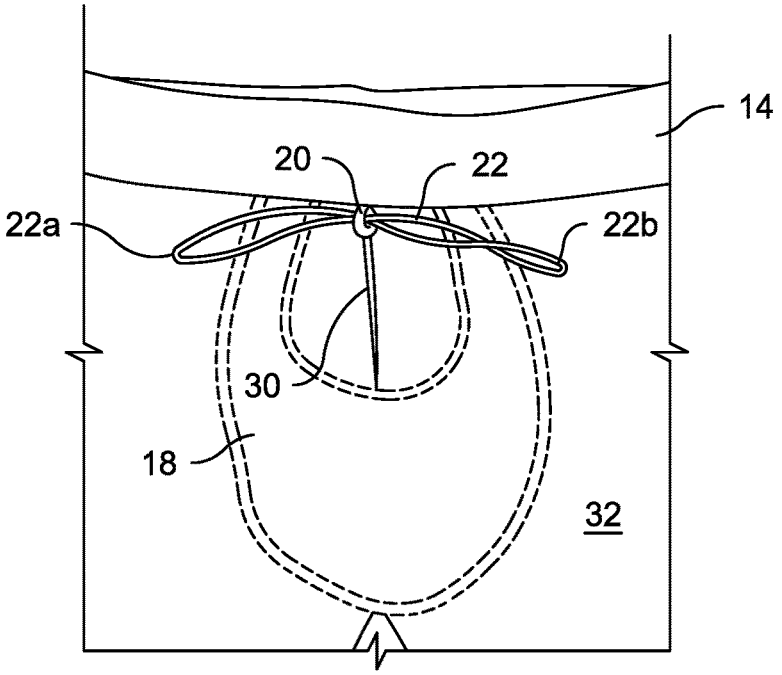
FIG. 5 is an inwardly facing front elevation view of a portion of the packer-support brief of FIG. 2 showing the round endless loop of FIG. 4 inserted in the attachment loop of FIG. 3.
Figure 6A:
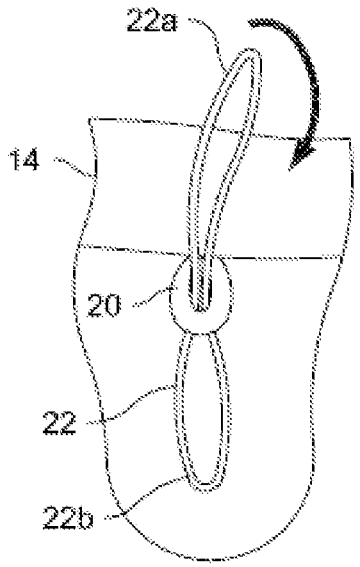
FIGS. 6A-6C show how a cow hitch is formed to attach the round endless loop of FIG. 4 to the attachment loop of FIG. 3 in accordance with the present invention.
Figure 6B:
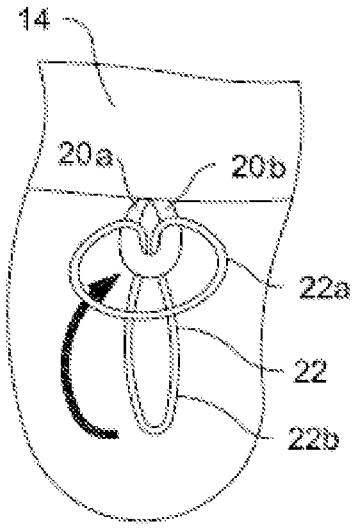
Figure 6C:
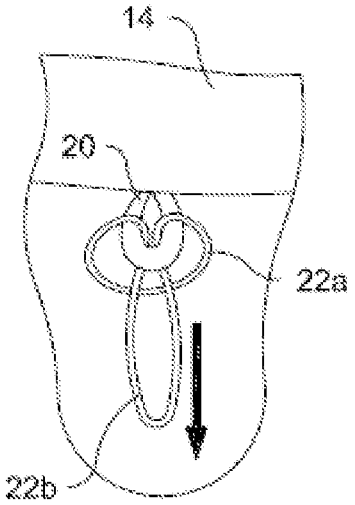
Figure 7:
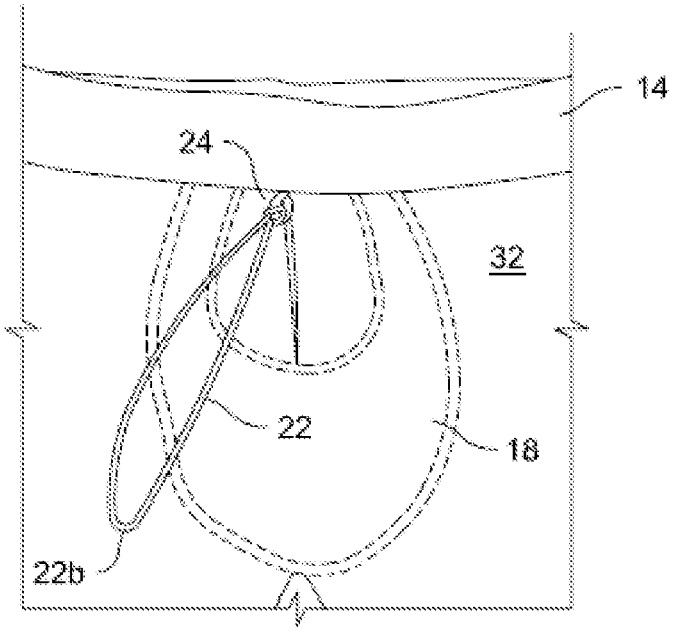
FIG. 7 is an inwardly facing front elevation view of a portion of the packer-support brief of FIG. 1 showing one end of the round endless loop of FIG. 4 attached by a cow hitch to the attachment loop of FIG. 3.
Figure 8:
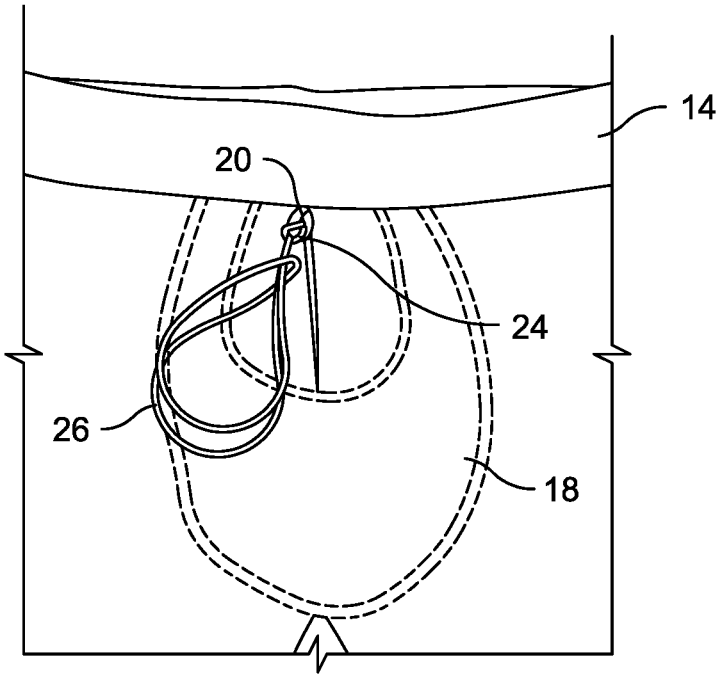
FIG. 8 is an inwardly facing front elevation view of a portion of the packer-support brief of FIG. 1 showing the formation of a cow hitch in an other end of the round endless loop of FIG. 4.
Figure 9:
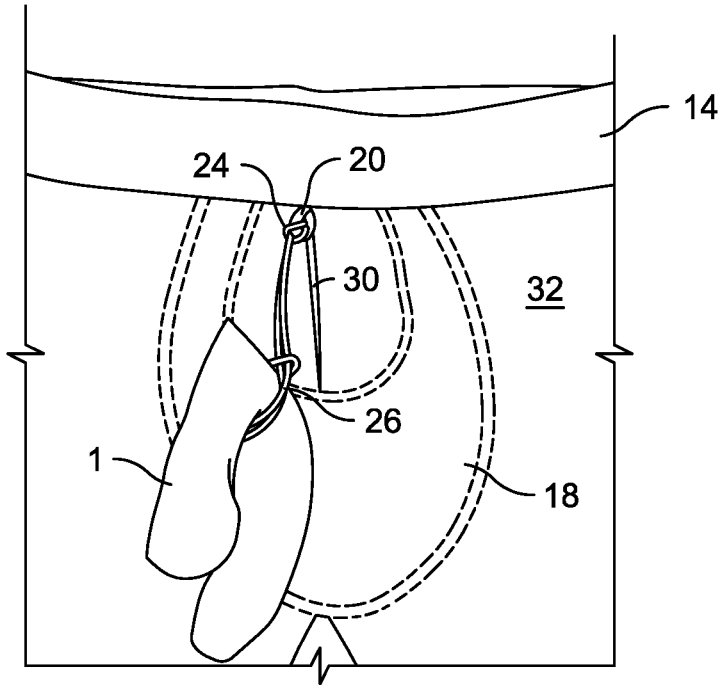
FIG. 9 is an inwardly facing front perspective elevation view of the cow hitch in the other end of the round endless loop of FIG. 4, attached to a packer.

Referring to the drawings in detail, where like numerals indicate like elements throughout, there is shown in FIGS. 1-9 a preferred embodiment of the packer-support brief, generally designated 10, and hereinafter referred to as the "packer-support brief" 10 in accordance with the present invention. The packer-support brief 10 provides for the secure positioning and releasable retention of a packer 1 in the packer-support brief 10.

The packer-support brief 10 comprises male underwear 12 in the form of a brief. A waistband 14 is provided at an upper-most portion 16 of the packer-support brief 10 the waistband circumscribing the entire brief. In some embodiments the waistband 14 may be formed from an elastic material. A pocket 18 is provided below the waistband 14.

The pocket 18 is configured to removably receive the packer 1. An attachment loop 20 having a first end 20*a* adjacent a second end 20*b* is attached to the waistband 14 and extends into the pocket 18. In some embodiments the attachment loop 20 may be attached to the waistband 14 by stitching. An endless loop 22 having a first portion 22*a* and a second portion 22*b* portion spaced from the second portion is provided. The first portion 22*a* of the endless loop 22 is attached to the attachment loop 20. The second portion 22*b* of the endless loop 22 is removably attachable to the packer 1.

Preferably, the first portion 22*a* of the endless loop 22 is attached to the attachment loop 20 by a first cow hitch knot 24 which comprises two half-hitches tied in opposing directions. To attach the endless loop 22 to the attachment loop 10 using the first cow hitch knot 24, the first portion 22*a* of the endless loop 22 is passed through the attachment loop 20 from underneath (see, FIG. 6*a*). The passed-through first portion 22*a* is pulled downward (see, FIG. 6*b*) and the second portion 22*b* of the endless loop 22 is passed through the first portion 22*a* of the endless loop 22 from underneath and pulled downward (see, FIG. 6*c*). The packer 1 is removably attachable to the second portion 22*b* of the endless loop 22 by a second cow hitch knot 26 (see, FIGS. 8 and 9).

The outwardly facing surface 28 of a front portion of the packer-support brief 10 has a vertical slit 30 configured to allow the packer 1 to be removably inserted therethrough and into the pocket 18. The inwardly facing surface 32 of the front portion of the packer-support brief 10 has an opening 34 configured to allow the packer 1 to be removably inserted therethrough and into the pocket 18.

The foregoing detailed description of the invention has been disclosed with reference to specific embodiments. However, the disclosure is not intended to be exhaustive or to limit the invention to the precise forms disclosed. Those skilled in the art will appreciate that changes could be made to the embodiments described above without departing from the broad inventive concept thereof. Therefore, the disclosure is intended to cover modifications within the spirit and scope of the present invention as defined by the appended claims.

I claim:

1. A packer-support brief for releasably retaining a packer in the packer-support brief, the packer-support brief comprising:

a male underwear in the form of a brief;

a waistband at an upper-most portion of the brief, the waistband circumscribing the entire brief;

a pocket below the waistband, the pocket configured to removably receive the packer;

an attachment loop attached to the waistband and extending into the pocket, the attachment loop having a first end adjacent a second end;

an endless loop having a first portion and a second portion spaced from the first portion, the first portion attached to the attachment loop; the second portion removably attachable to the packer, wherein the first portion of the endless loop is attached to the attachment loop by a first cow hitch.

2. The packer-support brief according to claim 1, wherein an outwardly facing surface of a front portion of the brief has a vertical slit configured to allow the packer to be removably inserted into the pocket therethrough.

3. The packer-support brief according to claim 1, wherein an inwardly facing surface of a front portion of the pocket has an opening configured to allow the packer to be removably inserted into the pocket therethrough.

4. The packer-support brief according to claim 1, wherein the waistband is elastic.

5. The packer-support brief according to claim 1, wherein the attachment loop is attached to the waistband by stitching.

6. A packer-support brief for releasably retaining a packer in the packer-support brief, the packer-support brief comprising:

a male underwear in the form of a brief;

a waistband at an upper-most portion of the brief, the waistband circumscribing the entire brief;

a pocket below the waistband, the pocket configured to removably receive the packer;

an attachment loop attached to the waistband and extending into the pocket, the attachment loop having a first end adjacent a second end;

an endless loop having a first portion and a second portion spaced from the first portion, the first portion attached to the attachment loop; the second portion removably attachable to the packer, wherein the second portion of the endless loop is attached to the packer by a second cow hitch when the packer is in the pocket.

7. The packer-support brief according to claim 6, wherein an outwardly facing surface of a front portion of the brief has a vertical slit configured to allow the packer to be removably inserted into the pocket therethrough.

8. The packer-support brief according to claim 6, wherein an inwardly facing surface of a front portion of the pocket has an opening configured to allow the packer to be removably inserted into the pocket therethrough.

9. The packer-support brief according to claim 6, wherein the waistband is elastic.

10. The packer-support brief according to claim 6, wherein the attachment loop is attached to the waistband by stitching.

* * * * *